United States Patent [19]

Becker et al.

[11] 4,419,860

[45] Dec. 13, 1983

[54] SPLICING HEAD

[75] Inventors: Rolf Becker, Monchen-Gladbach; Josef Bertrams; Franz Grabatsch, both of Wegberg; Gregor Kathke, Viersen; Wolfgang Kiesewetter, Willich; Herbert Knors, Monchen-Gladbach; Jakob Leven, Wegberg; Erich Quack, Monchen-Gladbach; Klaus Rautenberg, Erkelenz; Joachim Rohner, Monchen-Gladbach; Klaus Rosen, Monchen-Gladbach; Günter Wilms, Monchen-Gladbach; Heinz Zumfeld, Monchen-Gladbach, all of Fed. Rep. of Germany

[73] Assignee: W. Schlafhorst & Co., Monchen-Gladbach, Fed. Rep. of Germany

[21] Appl. No.: 368,114

[22] Filed: Apr. 14, 1982

[30] Foreign Application Priority Data

Apr. 15, 1981 [DE] Fed. Rep. of Germany ..... 3115234

[51] Int. Cl.[3] ..... D01H 15/00

[52] U.S. Cl. ..... 57/22

[58] Field of Search ..... 57/22, 23, 261

[56] References Cited

U.S. PATENT DOCUMENTS 3,339,362 9/1967 Dodson et al. ..... 57/22 X 3,487,618 1/1970 Arguelles ..... 57/22

*Primary Examiner*—Donald Watkins

*Attorney, Agent, or Firm*—Herbert L. Lerner; Laurence A. Greenberg

[57] ABSTRACT

Splicing device for producing a knot-free thread connection by splicing, including a splicing head having a longitudinal groove formed therein for the insertion of threads to be joined together, the splicing head having a plurality of cross grooves formed in the longitudinal groove and the splicing head having compressed air supply holes formed therein, at least two of the cross grooves having at least one compressed air supply hole terminating therein.

5 Claims, 4 Drawing Figures

SPLICING HEAD

The invention relates to a splicing head for producing a knot-free thread connection by splicing.

Splicing devices have become known, for example, from German Published, Non-Prosecuted Application DE-OS 2810 741. However, the applications of the known thread splicing devices are limited. For different types of threads or yarns, such as long-fiber yarns and short-fiber yarns and for different thread gauges and thread twists, splicing heads of varied dimensions are used.

It is accordingly an object of the invention to provide a splicing head which overcomes the hereinafore-mentioned disadvantages of the heretofore-known devices of this general type, and to provide a universally applicable splicing head, which can produce stronger, better looking and more durable splice connections.

With the foregoing and other objects in view there is provided, in accordance with the invention, a splicing device for producing a knot-free thread connection by splicing, comprising a splicing head having a longitudinal groove formed therein for the insertion of threads to be joined together, the splicing head having a plurality of cross grooves formed in the longitudinal groove and the splicing head having compressed air supply holes formed therein, at least two of the cross grooves having at least one compressed air supply hole terminating therein.

In accordance with another feature of the invention, the splicing head has at least one compressed air collection chamber formed therein being connected to the compressed air supply holes.

In accordance with a further feature of the invention, the compressed air supply holes terminate in the cross grooves at or coming from the bottom thereof.

In accordance with an added feature of the invention, the compressed air supply holes terminate in the cross grooves at or from a side thereof.

In accordance with a concomitant feature of the invention, the compressed air supply holes terminate in the cross grooves at or coming from both sides thereof.

The advantages obtained by practicing the invention are especially seen in the fact that the spliced connection has a better appearance and more strength, and that this can be achieved advantageously with a compact splicing head which can be economically manufactured. The individual fibers are more intimately and more uniformly mixed. The air jet which effects the splicing action is divided into several single jets, which terminate in the cross grooves, and the cross grooves create a turbulent air distribution. The endings of the individual fibers are also additionally wound around the splice connection by the air spin created thereby. This is considered to be the cause for the increased strength of the splice connection.

Other features which are considered as characteristic for the invention are set forth in the appended claims.

Although the invention is illustrated and described herein as embodied in a splicing head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
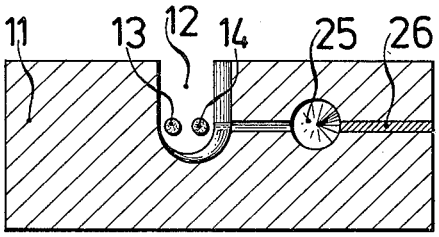
FIG. 1 is a diagrammatic cross-sectional view of a first splicing head of the invention.
Figure 2:
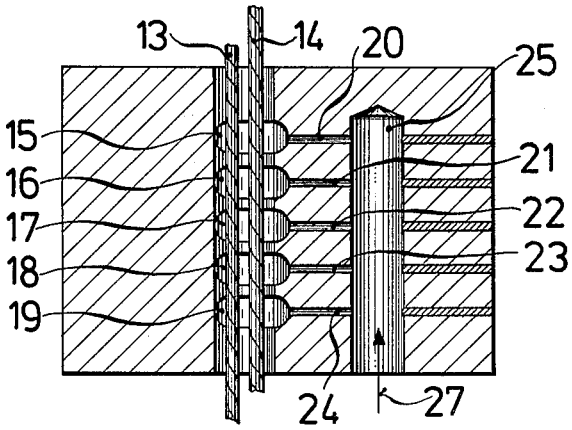
FIG. 2 is a longitudinal-sectional view through the first splicing head.

Referring now to the figures of the drawing and first particularly to FIGS. 1 and 2 thereof, there is seen a first splicing head 11 which is shaped as a block, and is formed of one piece. The splicing head 11 has a longitudinal groove 12 formed therein for insertion of the threads 13, 14 which are to be connected together. The threads are inserted into the longitudinal groove 12 so as to overlap each other and the threads come from both sides.

Several cross grooves 15 to 19 are provided in the groove 12. The groove 12 has a U-shaped profile. The cross grooves 15 to 19 are disposed in the right sidewall and in the bottom of the longitudinal groove 12. The left sidewall has no cross grooves. A hole 20 to 24 for compressed air terminates in each of these cross grooves 15 to 19 from the side.

The bores 20 to 24 for compressed air supply are connected to a chamber 25 for collecting the compressed air, the chamber also being located in the splicing head 11.

The splicing head 11 can be very easily manufactured. First, the longitudinal groove 12 is milled in a metal block and thereafter the cross grooves 15 to 19 are milled. The bores for the compressed air and the air collection chamber are created by drilling from the sides. Finally, the outer ends 26 of the bores 20 to 24 for compressed air are closed by cast or solid plugs.

Since devices for making a knot-free thread joint by splicing are known in the art, there are no further explanations made at this point as to how such a splicing device is made. After the threads are inserted, the splicing is effected by a compressed air thrust or push in the direction of an arrow 27.

Figure 4:
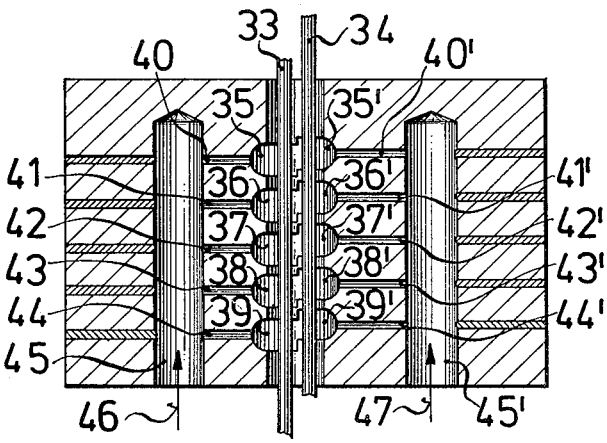
FIG. 4 is a longitudinal-sectional view through the second splicing head.

In the second typical embodiment of the invention, the splicing head 31 has a longitudinal groove 32 formed therein. The two threads 33 and 34 which are to be spliced to each other have already been inserted in the longitudinal groove 32. A total of 10 cross grooves are provided in the longitudinal groove 32. On the left side of FIG. 4 there are seen cross grooves 35 to 39, and on the right side there are seen cross grooves 35' to 39'.

The longitudinal groove 32 in this embodiment also has a U-shaped cross section. The cross grooves 35 to 39 are located in the left sidewall and in the bottom, the cross grooves 35' to 39' are in the right sidewall and in the bottom of the longitudinal groove 32. The two rows of cross grooves are somewhat displaced or offset with respect to each other, in such a manner that cross grooves with the same reference numeral overlap each other in pairs. This arrangement of the cross grooves results in an especially advantageous air turbulence effect, and thereby produces excellent splices.

A bore for the compressed air terminates in each cross groove. At the left side these are the bores 40 to 44 for compressed air, and at the right side these are the compressed air holes 40' to 44'.

The bores 40 to 44 for the compressed air are connected to a chamber 45 for collecting the compressed air, and the bores 40' to 44' are connected to a chamber 45' for collecting the compressed air.

Thus, the bores for the compressed air end in the cross grooves from opposite sides. The splicing is effected by simultaneous air thrusts in the direction of the arrows 46 and 47. The manufacture of the splicing head 31 is just as simple as the manufacture of the splicing head 11, and is performed in the same manner.

Figure 3:
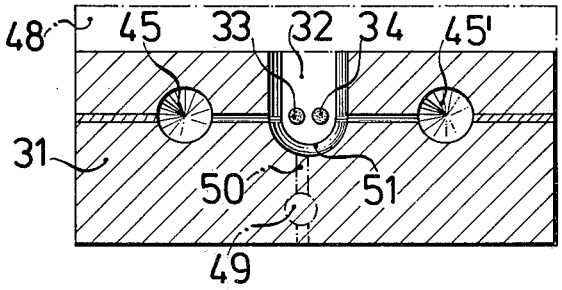
FIG. 3 is a diagrammatic cross-sectional view of a second splicing head of the invention.

FIG. 3 also shows two alternative versions for the construction of the device. In one construction, the longitudinal groove 32 can be closed during the splicing operation by a cover 48, which is indicated by dot-dash lines. In the second version, a collecting chamber 49 for the compressed air is provided as indicated by dot-dash lines, from which bores 50 for the compressed air lead to the bottom 51 of the groove. This alternate construction can serve as an additional compressed air supply, or as the only supply for the compressed air.

The invention is not limited to the described and illustrated typical embodiments. It is especially noted that the form of the cross section of the longitudinal groove should not be limited to a U-shape. It is not necessary for all of the cross grooves to contain a bore for supplying compressed air. The cross grooves can be disposed symmetrically with respect to the longitudinal groove, thereby deviating from the described embodiment. It is also possible to provide terminations of two or three holes for compressed air in each cross groove.

The foregoing is a description corresponding to German Application P 31 15 234.1, dated Apr. 15, 1981, the International priority of which is being claimed for the instant application, and which is hereby made part of this application. Any discrepancies between the foregoing specification and the aforementioned corresponding German application are to be resolved in favor of the latter.

We claim:

1. Splicing device for producing a knot-free thread connection by splicing, comprising a splicing head having a longitudinal groove formed therein for the insertion of threads to be joined together, said splicing head having a plurality of cross grooves formed in said longitudinal groove and said splicing head having compressed air supply holes formed therein, at least two of said cross grooves having at least one compressed air supply hole terminating therein.

2. Splicing device according to claim 1, wherein said splicing head has at least one compressed air collection chamber formed therein being connected to said compressed air supply holes.

3. Splicing device according to claim 1 or 2, wherein said compressed air supply holes terminate in said cross grooves at the bottom thereof.

4. Splicing device according to claim 1 or 2, wherein said compressed air supply holes terminate in said cross grooves at a side thereof.

5. Splicing head according to claim 1 or 2, wherein said compressed air supply holes terminate in said cross grooves at both sides thereof.

* * * * *